US005078380A

United States Patent [19]

Kitazawa

[11] Patent Number: 5,078,380

[45] Date of Patent: Jan. 7, 1992

[54] APPARATUS FOR FEEDING SHEET MATERIAL

[75] Inventor: Osamu Kitazawa, Tokyo, Japan

[73] Assignee: Kabushiki Kaisha Toshiba, Kanagawa, Japan

[21] Appl. No.: 519,096

[22] Filed: May 4, 1990

[30] Foreign Application Priority Data

Aug. 30, 1989 [JP] Japan ..... 1-223698

[51] Int. Cl.[5] ..... B65H 5/26

[52] U.S. Cl. ..... 271/9; 271/127; 271/155; 271/164

[58] Field of Search ..... 271/110, 117–118, 271/126, 127, 148, 152, 153, 155, 164, 9, 162

[56] References Cited

U.S. PATENT DOCUMENTS 3,563,535 2/1971 Vitu et al. ..... 271/164
4,319,742 3/1982 Ulseth ..... 271/127
4,763,891 8/1988 Kodama ..... 271/127
4,925,177 5/1990 Nakamura et al. ..... 271/110

FOREIGN PATENT DOCUMENTS 39638 3/1984 Japan ..... 271/127
211228 9/1987 Japan ..... 271/126
171719 7/1988 Japan ..... 271/155

*Primary Examiner*—H. Grant Skagg
*Attorney, Agent, or Firm*—Banner, Birch, McKie & Beckett

[57] ABSTRACT

A copying machine includes an image-forming device and a cassette feeder accompanying a plurality of cassettes. The cassette comprises a body without a base and a base plate located at a base portion. When the cassette is inserted into the cassette feeder, a push-up member provided in the cassette feeder pushes up one end of the base plate of the cassette such that the top sheet of paper sheets stored in the cassette is brought into contact with a pick-up roller provided in the cassette feeder.

11 Claims, 11 Drawing Sheets

APPARATUS FOR FEEDING SHEET MATERIAL

BACKGROUND OF THE INVENTION

1. Field of the Invention

The present invention generally relates to a novel apparatus for storing and dispensing sheet material, and more particularly, to an apparatus for feeding sheet material from a cassette which holds a plurality of material sheets.

2. Description of the Related Art

An image forming apparatus, such as a copying machine, a facsimile machine or a printer, forms an image onto sheet material consisting of, for example, individual sheets of paper.

A cassette is used for supplying individual paper sheets to the image forming apparatus. Prior art cassettes are known that comprise a body which is open at the top for supplying the paper. Such cassettes include a paper-receiving plate which is spaced by a spring from the base surface of the body. The spring urges the paper-receiving plate, and therefore the paper, upwardly so that each individual sheet can be easily removed from the cassette. The cassette includes a paper retaining lip located on the edge of the top surface of the cassette in order to prevent the uppermost sheet from being forced out of the cassette by the action of the spring.

According to this prior art structure, the cassette in cooperation with a paper pick up roller, supplies each individual sheet sequentially to the image forming apparatus.

Since the prior art design requires a cassette with additional elements, there is less space available for storing paper sheets. As previously discussed, the prior art cassette consists of an open box with the paper-receiving plate spaced by a spring from the fixed bottom surface. The use of a paper receiving plate and spring necessarily limits the space available for the paper supply. Furthermore, since additional elements are needed for each cassette to store and dispense paper, the prior art cassettes are more costly to manufacture. Also, an operator must replenish the paper stored in the cassette more frequently, especially in the case of a high-speed, image forming apparatus.

SUMMARY OF THE INVENTION

Accordingly, it is an object of the present invention to provide an improved apparatus for feeding sheet material from a cassette which is capable of storing a plurality of material sheets.

It is another object of the present invention to provide a single and improved apparatus for storing and dispensing sheet material from a cassette.

It is another object of the present invention to provide an improved and low cost apparatus for storing and dispensing sheet material from a cassette.

A still further object of the present invention is to provide an improved apparatus that can be easily manufactured for storing and dispensing sheet material.

Another object of the present invention is an improved cassette having a simple construction for storing sheet material without the need for complicated and costly components.

In accordance with the present invention, an apparatus for feeding sheet material comprises a cassette body having four walls and an open base area. A shoulder or lip is provided on the cassette body extending along the perimeter of the open base area. The shoulder or lip supports the edges of a movable paper receiving "plate"; at the base of the cassette body for holding the sheet material. A paper-lifting means is positioned adjacent the paper-receiving plate for urging the paper-receiving plate upwardly toward a pick-up roller. The pick-up roller then contacts the upper sheet for dispensing it.

BRIEF DESCRIPTION OF THE DRAWINGS

Other objects and many of the attendant advantages of this invention will be readily appreciated as the invention becomes better understood by reference to the following detailed description when considered in connection with the accompanying drawings, in which like reference characters designate the same or similar parts throughout the figures thereof and wherein.

DESCRIPTION OF THE PREFERRED EMBODIMENTS

Figure 1:
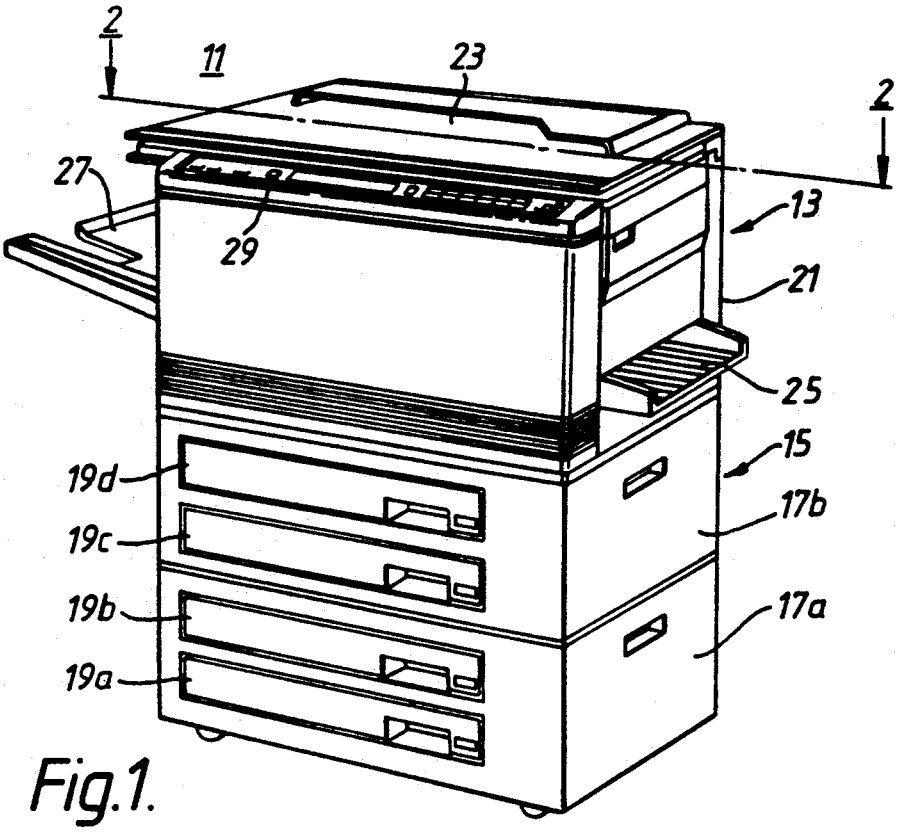
FIG. 1 is a perspective view of a copying machine according to the present invention.

Referring to FIG. 1, an image-forming apparatus, such as a copying machine 11, comprises an image-forming section 13 for forming an image corresponding to an input document to be copied or data supplied by an operator.

Section 13 is mounted on a feeding apparatus 15 for feeding sheet material (e.g., paper) into image-forming section 13. Feeding apparatus 15 comprises a plurality of cassette feeders 17 (e.g., lower and upper cassette feeders **17*a* and 17*b*) for receiving one or a plurality of cassettes 19 (e.g., cassettes 19*a*, 19*b*, 19*c* and 19*d*, respectively). Cassettes 19** store a plurality of sheets of paper having the same or different sizes, respectively.

Image-forming section 13 comprises a body 21 having a document-receiving section 23 hinged at the rear of body 21 near its top surface whereby the document to be copied can be placed in the receiving section 23. A manual feeding tray 25 is provided at the right side of body 21 for manually receiving and feeding paper into the image-forming section. A tray 27 is provided at the left side of body 21 to dispense the copied paper. A control panel 29 is provided on the upper portion of body 21 for accepting operating commands and generating a plurality of signals corresponding to the operating commands.

Figure 2:
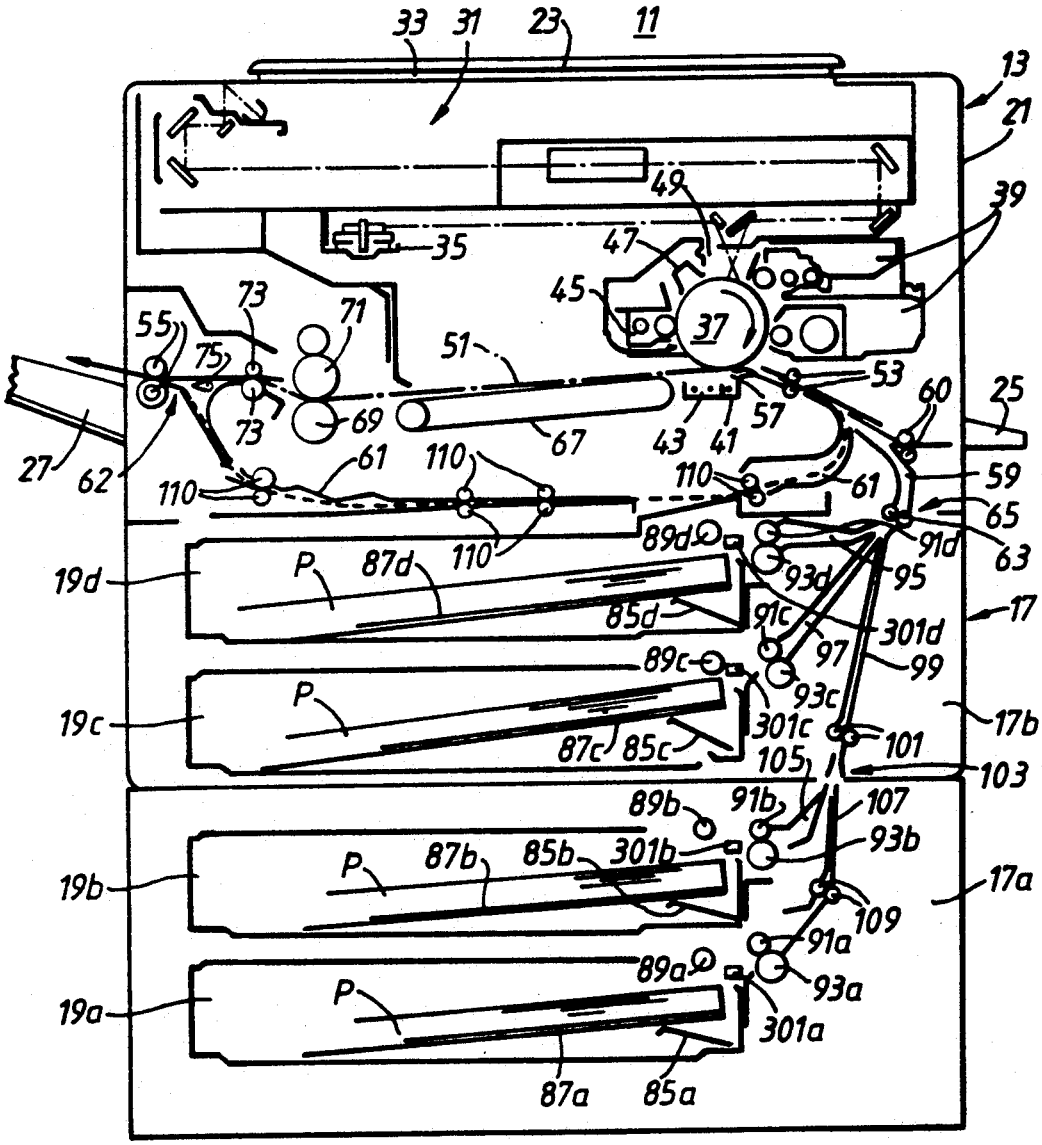
FIG. 2 is a diagrammatic sectional view along line 2—2 of the copying machine shown in FIG. 1.

Details of copying machine 11 will be explained with reference to FIG. 2. Image-forming section 13 comprises an optical unit 31 which scans the document to be copied (e.g. document 33). According to the present embodiment, an operator may input additional data through control panel 29 (See FIG. 1) in the event a complex image is desired consisting of the document's image and an image corresponding to the data supplied through control panel 29. A laser optical unit 35 is provided under optical unit 31 to produce a laser beam according to the additional data supplied by the operator. Supplying additional data (e.g., date, author, distribution, etc.) for recording on the copied document is described in copending U.S. application Ser. No. 454,947 entitled "Image Forming Apparatus" filed on Dec. 22, 1989.

An image is formed on a photosensitive drum 37, located under optical unit 31 and laser optical unit 35, in response to the light from optical unit 31 and the laser beam from laser optical unit 35. Drum 37 rotates in synchronism with the operation of optical unit 31 and optical unit 35. Along the rotational direction of drum 35 several image processing elements are provided, including a developing device 45, a discharging device 47, and a charging device 49. The details of optical unit 31, laser optical unit 35, developing device 39, transferring device 41, separating device 43, cleaning device 45, discharging device 47 and charging device 49 are disclosed in the above identified copending application, which is incorporated herein by reference.

A main paper path 51 extends along the path from a pair of aligning rollers 53 through a transferring position 57 to a pair of exit rollers 55. At position 57, a toner image on drum 37 is transferred onto the surface of the paper. Aligning rollers 53 receive the paper from either of two paths, a path 59 from the cassettes or a path 61 (i.e. a reverse path) which permits double sided copying. Cassette path 59 extends from aligning rollers 53 to a pair of first inlet aligning rollers 63. First inlet aligning rollers 63 are located at an inlet 65 of photocopier body 21. Cassette feeder 17 (e.g., upper cassette feeder **17*b*) communicates with the photocopier through inlet 65. Paper manually fed from feeder tray 25 joins paper cassette path 59 via rollers 60**.

A conveying belt 67 is provided along main paper path 51 for conveying the paper from drum 37 after toner is transferred at transferring point 57. A heating roller 69 and a pressure roller 71 are provided along path 51 between conveying belt 67 and exit roller 55 for fixing toner onto the paper. A pair of conveying rollers 73 is provided along the path between exiting and heating rollers 55 and 69, respectively.

Reverse path 61 extends between a downstream point 62 on main path 51 and aligning rollers 53. This point is located between exit and conveying rollers 55 and 73. A gate 75 is provided near the end of main path 51 and the beginning of reverse path 61. Gate 75 guides the paper with toner fixed on one side to either exit roller 55 along main path 51 or to reverse path 61. This path selecting operation is performed by CPU 303 (see FIG. 6) in accordance with information supplied from control panel 29 (see FIG. 1). That is, reverse path 61 is used if double-sided copying is desired by the operator.

The operation of cassette feeders **17*a* and 17*b* will now be explained. Cassette feeder 17*b* includes two cassettes: upper cassette 19*d* and lower cassette 19*c*. A first upper paper path 95 extends from first inlet aligning rollers 63 to a pair of feeding and separating rollers 91*d* and 93*d* for cassette 19*d*. A second upper paper path 97 extends from first inlet aligning rollers 63 to a pair of feeding and separating rollers 91*c* and 93*c* for cassette 19*c*. An intermediate path 99 extends from first inlet aligning rollers 63 to a pair of second inlet aligning rollers 101 located near an inlet 103 of upper feeder 17*b* through which paper is supplied from lower feeder 17*a*. Cassette feeder 17*a* includes two cassettes: cassette 19*b* and cassette 19*a*. A first lower path 105 extends from inlet 103 to a pair of feeding and separating rollers 91*b* and 93*b* for cassette 19*b*. A second lower path 107 extends from inlet 103 to a pair of feeding and separating rollers 91*a* and 93*a* through a pair of third inlet aligning rollers 109 for cassette 19*a***.

Aligning rollers 63, 101 and 109 align the paper that has traveled to them by momentarily ceasing rotation. As a result, the leading edge of the paper will align with the tangential contact point of the contiguous rollers. Thereafter, the paper will continue its travel along the path upon resumption of rotation of the rollers.

The movement of paper P will be explained with reference to cassette **19*a*. After insertion of cassette 19*a* into cassette feeder 17, a paper lifting member 85*a*, located inside cassette feeder 17*a*, urges a paper receiving plate 87*a* which forms a base plate of cassette 19*a*. Cassette 19*a* holds a stack of paper sheets P. The action of paper lift member 85*a* urges the paper toward a paper pick-up roller 89*a*. Pick-up roller 89*a* faces the top sheet of papers P for receiving the top sheet. Pick-up roller 89*a* is rotated in accordance with information supplied from control panel 29. That is, control panel 29 designates which of the cassettes (i.e., 19*a*, 19*b*, 19*c*, 19*d*) and therefore the pick-up rollers (89*a*, 89*b*, 89*c*, 89*d*) are selected. This designation may depend upon the type of paper (e.g., its size) desired by the operator. In this case, cassette 19*a* is selected. Pick-up roller 89*a* removes the top sheet and supplies it to feeding and separating rollers 91*a* and 93*a*. These rollers convey the paper, sheet by sheet. Third inlet aligning rollers 109, after aligning the leading edge of the sheet, convey it toward second inlet aligning rollers 101 via second lower path 107. Second inlet aligning rollers 101, after aligning the leading edge of the sheet, convey it along intermediate path 99 toward first inlet aligning rollers 63. First inlet aligning rollers 63, after aligning the leading edge of the sheet, convey it along cassette path 59 toward aligning rollers 53**.

Aligning rollers 53, after aligning the leading edge of the sheet, convey it in synchronism with the rotation of drum 37 to point 57 where the image is transferred to the paper. After passing through transferring point 57, the paper with toner is separated from drum 37. Gate 75 guides the paper, now with its toner image fixed by heating roller 69, toward tray 27 along main path 51 or toward aligning rollers 53 along reverse path 61. For single-sided copy operation, the paper is conveyed onto tray 27 through rollers 55. For double-sided copy operation, paper P is conveyed along reverse path 61. A plurality of rotating rollers 110, located along reverse path 61, convey the paper toward aligning rollers 53 along reverse path 61. The paper is again conveyed along reverse path 61 toward transferring point 57. A toner image is then formed on the other side of the sheet so that double-sided copying will be completed.

Figure 3:
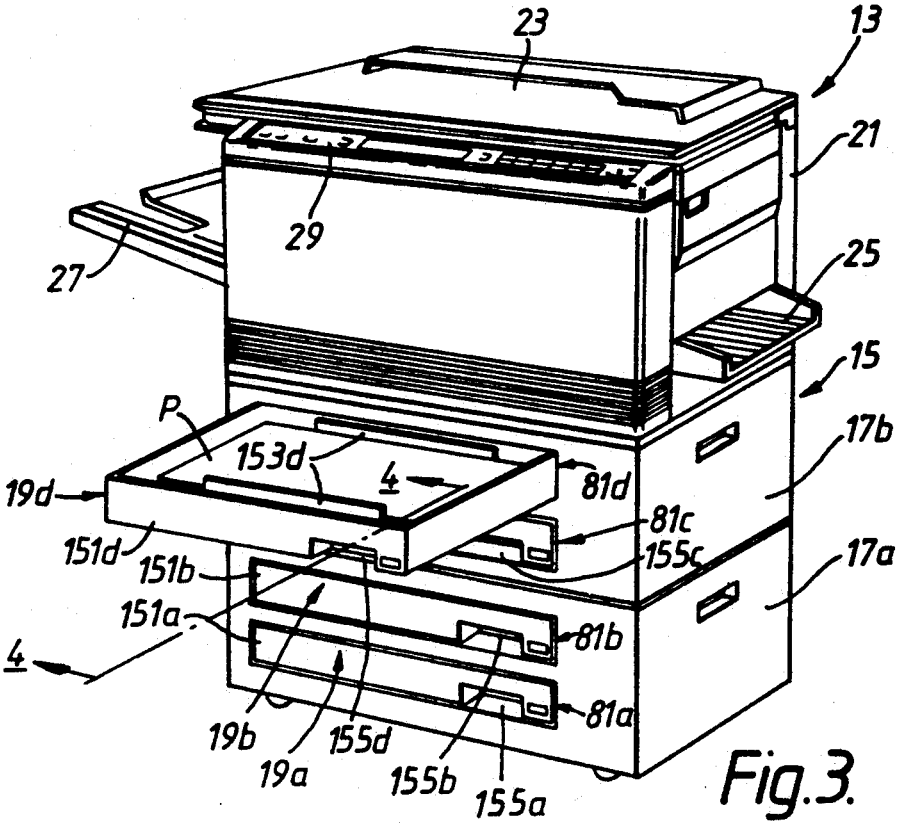
FIG. 3 illustrates a cassette used in the copying machine shown in FIG. 1.

As described below, the invention includes a visual cassette design and feeder. The invention will be described with respect to cassette **19*b*, although the other cassettes are identical in construction. As shown in FIG. 3, cassette 19b comprises cassette body 151b including side walls and an open base area. A shoulder is provided on the cassette body extending along the perimeter of the open base area. This shoulder supports the edges of a pivotally movable paper receiving plate 87b (see FIG. 2), at the base of the cassette body, for holding a plurality of sheets. The paper stored in the cassette is picked up by pick-up roller 89b and is conveyed along a direction parallel to the scanning direction of optical unit 33. Each cassette 19b is inserted into, and removed from, cassette feeder 17a along a direction perpendicular to the paper path. A pair of spaced guide plates 153b, extending parallel to the scanning direction, for aligning and guiding the sheets as they are removed and transferred to the transferring point are provided on each cassette. At the front side of cassette body 151b, a handle recess 155b** and a paper type identifying label are provided.

Figure 3A:
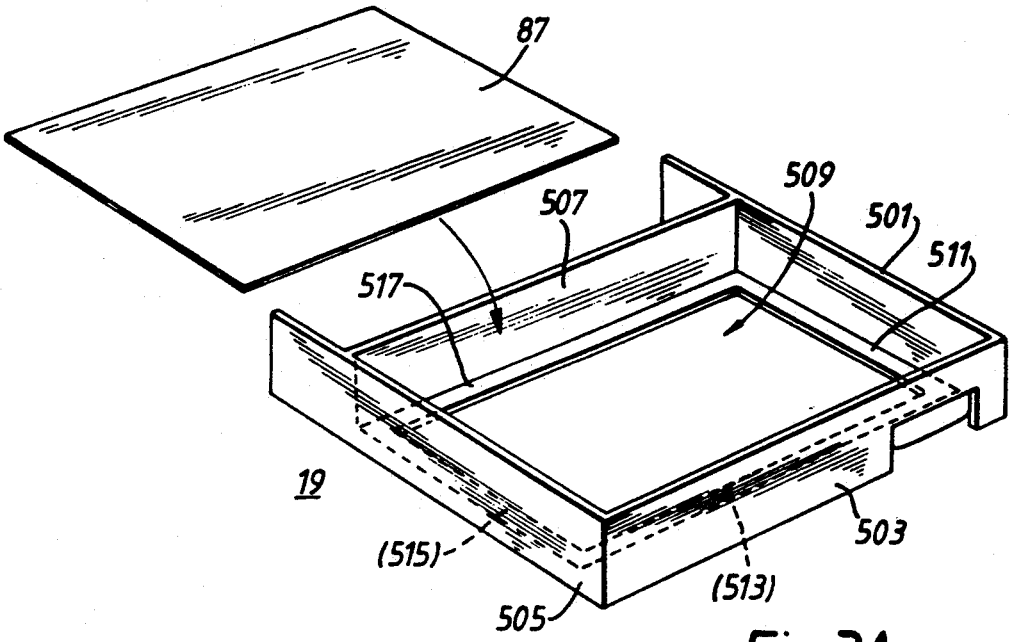
FIGS. 3A to 3H show variations of a cassette body in accordance with the present invention.

FIG. 3A shows a cassette 19 having four walls 501, 503, 505 and 507, an open base area 509, and four shoulders 511, 513, 515 and 517 positioned at open base area 509. Paper-receiving plate 87 is adapted to be positioned on shoulders 511, 513, 515 and 517.

Figure 3B:
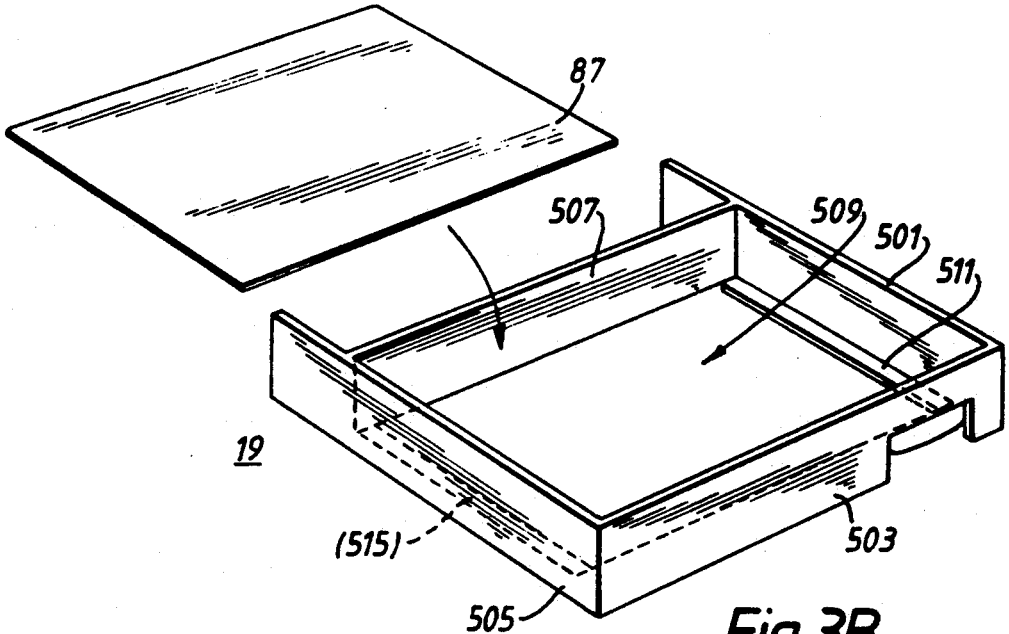

FIG. 3B shows a cassette 19 having four walls 501, 503, 505, and 507, an open base area 509, and two shoulders 511 and 515.

Figure 3C:
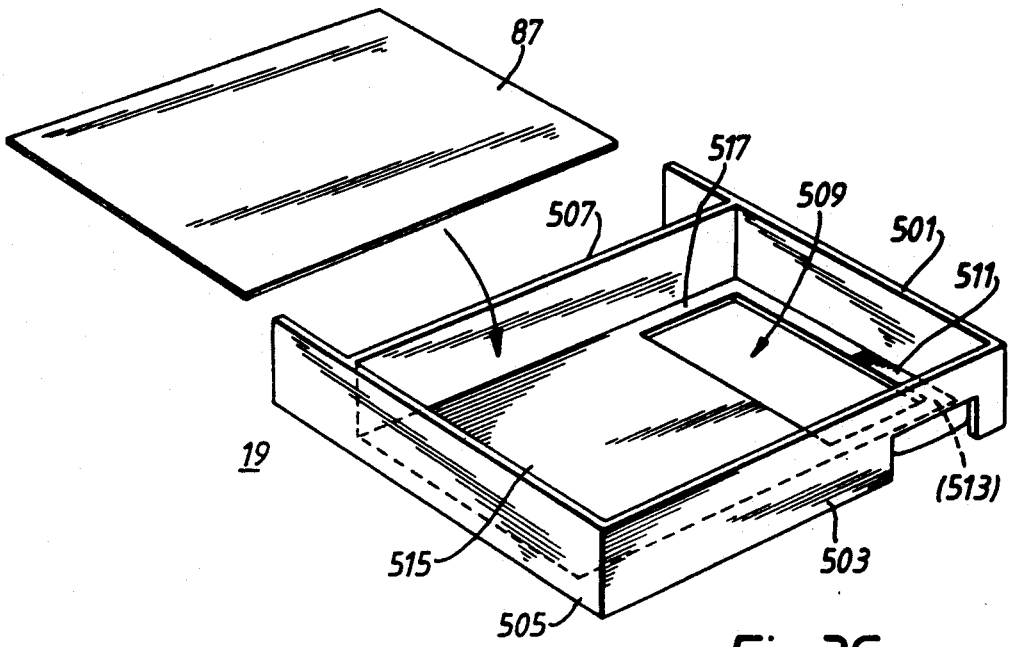

FIG. 3C shows a cassette 19 having four walls 501, 503, 505, and 507, an open base area 509, and shoulders 511, 513, 515 and 517. Shoulder 515 is larger than the other shoulders.

Figure 3D:
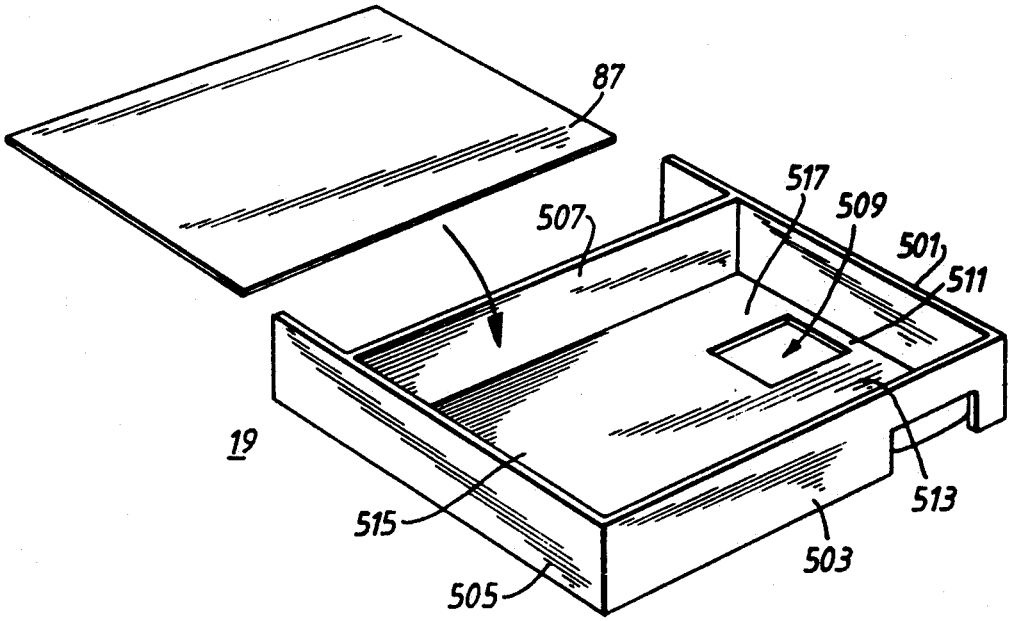

FIG. 3D shows a cassette 19 having four walls 501, 503, 505, and 507, an open base area 509, and shoulders 511, 513, 515, and 517.

Figure 3E:
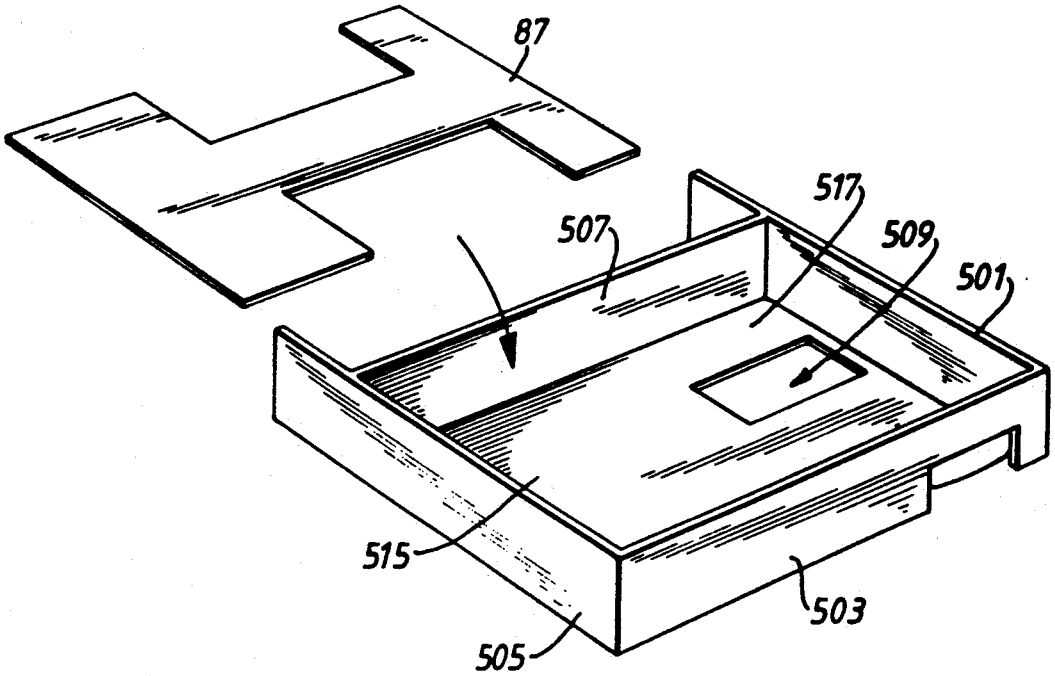

FIG. 3E shows a cassette 19 similar in construction to the cassette 19 shown in FIG. 3D. Paper-lifting plate 87, however, is H-shaped so that plate 87 is light and easy to move. Furthermore, it is possible to locate spaced guide members for guiding various sizes of papers as shown in FIG. 3H below.

Figure 3F:
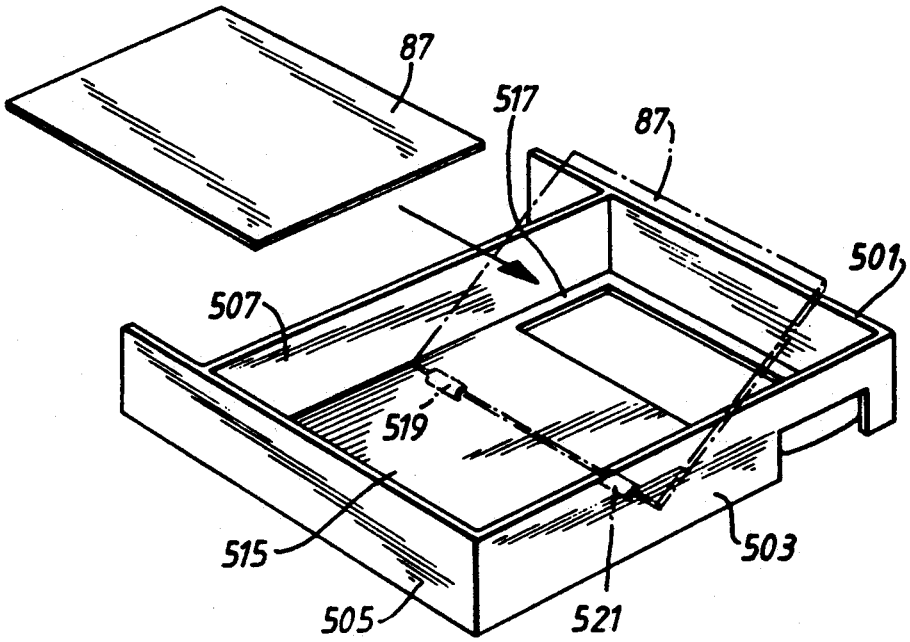

FIG. 3F shows a cassette 19, similar in construction to cassette 19 shown in FIG. 3C. Paper-lifting plate 87 covers open base area 509 and covers about half of shoulder 515. Paper-lifting plate 87 is adapted to be pivotally coupled to shoulder 515 through a pair of hinge members 519 and 521 shown in phantom.

Figure 3G:
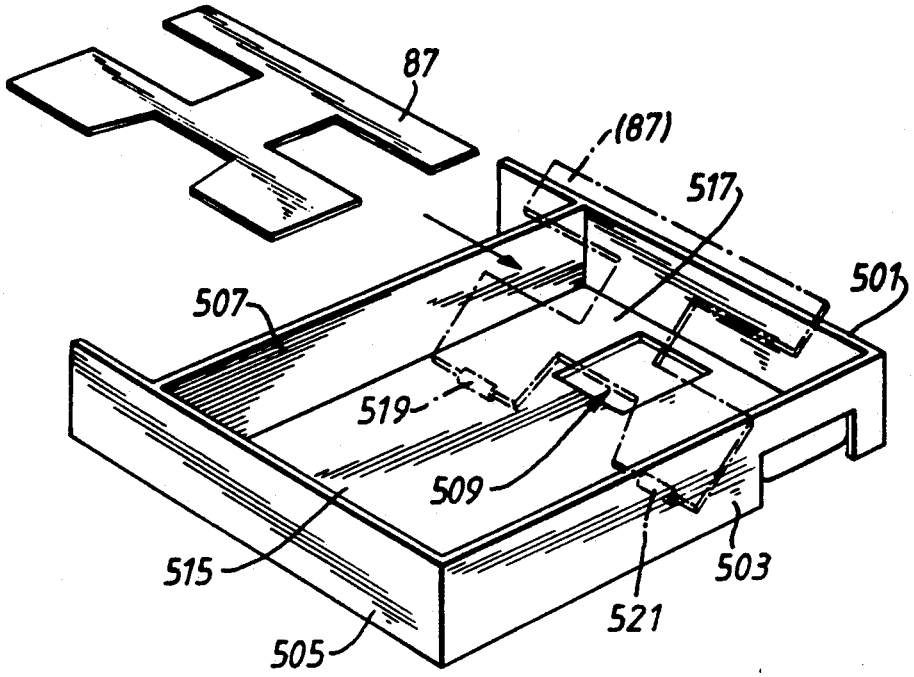

FIG. 3G shows a cassette 19, in which paper lifting plate 87 is H-shaped.

Figure 3H:
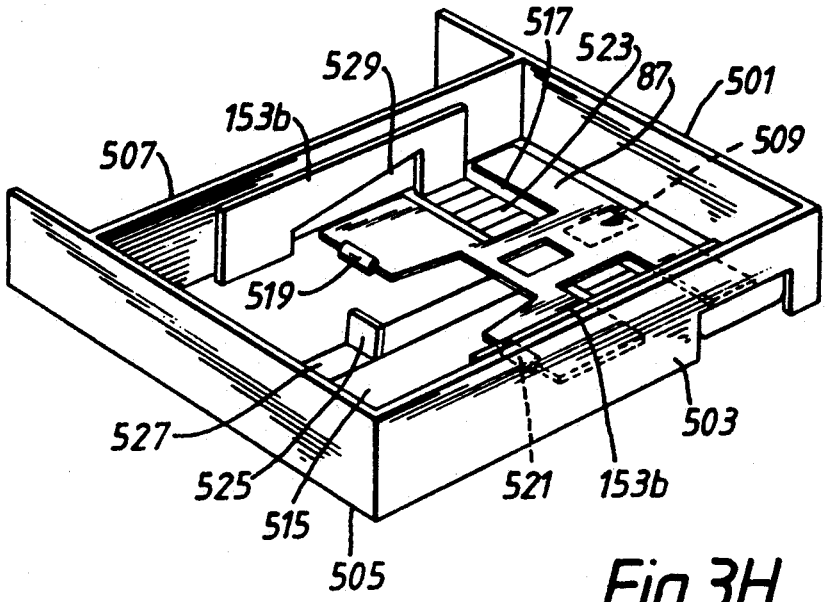

FIG. 3H illustrates the detail of cassette 19 shown in FIG. 3G. A pair of spaced guide plates 153b are movable laterally along a first sliding element 523. Guide plates 153b cooperate with an adjusting element 525 movable longitudinally on a second sliding element 527 along shoulder 515. This design holds paper P when the positions of guide plates 153b and adjusting element 525 are properly adjusted for the desired paper size. Guide plate 153b has a cutway 529 on the side in order to fail to obstruct the movement of paper lifting plate 87.

Figure 4:
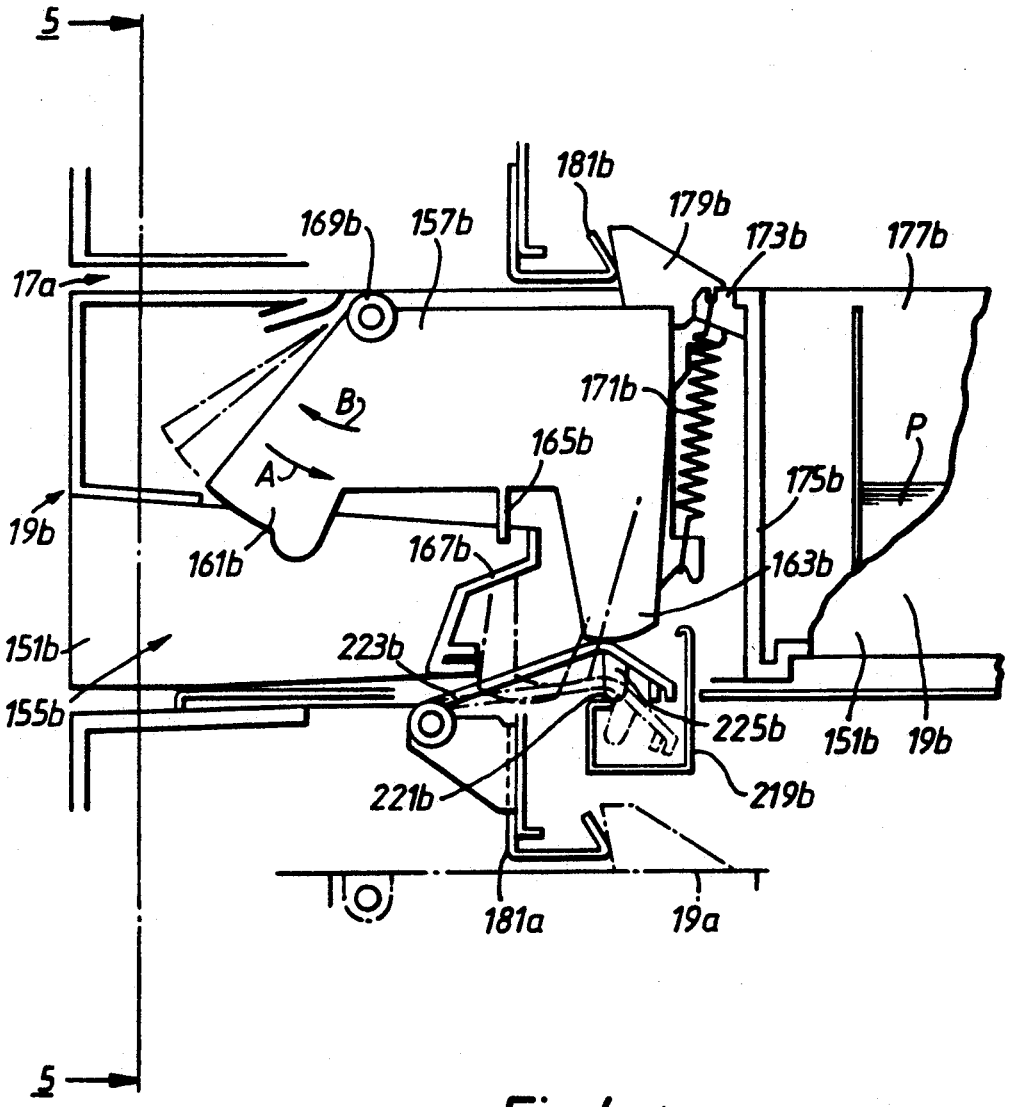
FIG. 4 is a sectional view along line 4—4 of the cassette and a portion relating to the cassette (hereinafter referred to as a cassette portion) shown in FIG. 3.

As shown in FIG. 4, a handle 157b is provided at handle recess 155b to mechanically latch cassette 19b to, and from, cassette feeder 17a. Handle 157b comprises a hand grip portion 161b and a cam lobe 163b positioned opposite to grip portion 161b. A plate portion 165b is provided between grip and cam lobe portions 161b and 163b. Handle plate portion 165b in cooperation with a partitioning plate 167b on the cassette body, prevents viewing of the inside of cassette 17a.

Handle 157b is pivotally moved around an axle 169b coupled to the upper portion of cassette body 151b. A spring 171b is provided between the lower portion of cam lobe 163b and a hook 173b located at the upper position of a plate 175b. Plate 175b separates paper container portion 177b from handle 157b. Spring 171b urges grip portion 161b counterclockwise along the direction of the arrow A, shown in FIG. 4.

Handle 157b includes a claw 179b on its upper surface (i.e., the uppermost position of projection portion 163b). Claw 179b is adapted to be latched in a clasp 181b coupled to cassette feeder 17a. When portion 161b of handle 157b is moved along the direction of arrow B to expand spring 171b, claw 179b is separated from clasp 181b. As a result, cassette 19b may be removed from cassette feeder 17a.

Figure 5:
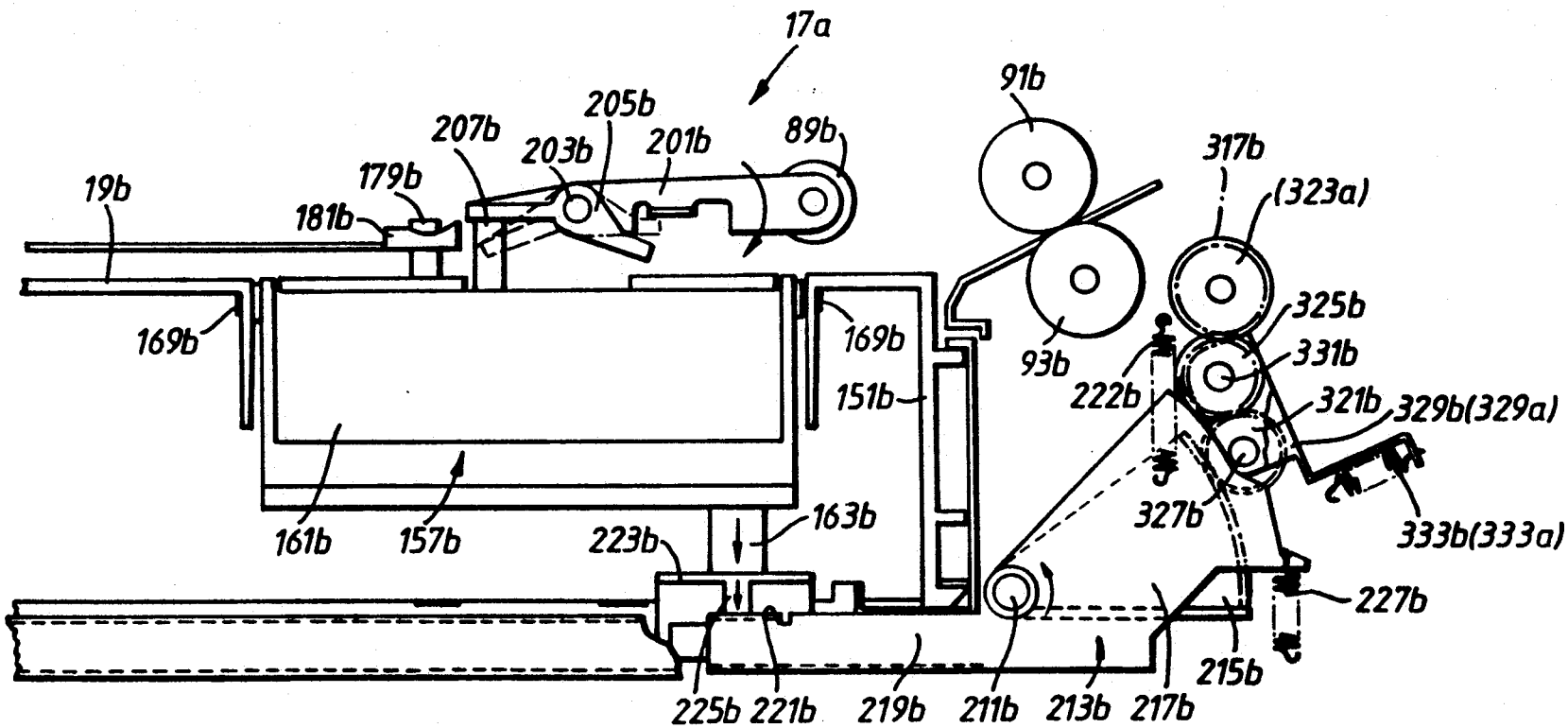
FIG. 5 is a sectional view along line 5—5 of the cassette portion shown in FIG. 4.

Further details of cassette feeder 17a and the operation of handle 157b will be described with reference to FIG. 5. Pick-up roller 89b is provided at one end of an arm 201b. Arm 201b and a lever 205b are pivotable around an axle 203b. Lever 205b is coupled to arm 201b through a torsion spring (not shown). Whenever lever 205b is pivoted about axle 203b, arm 201b is likewise pivoted in the same direction. Arm 201b moves pick-up roller 89b to a first predetermined position where it engages the top sheet of papers P stored in cassette 19b. Arm 201b also moves pick-up roller 89b to a second predetermined position where it disengages the top sheet.

A projection 207b is provided near claw 179b on the surface of handle 157b; consequently, projection 207b moves together with grip portion 161b. Moving portion 161b of handle 157b in the direction of arrow B, claw 179b is then separated from clasp 181b. As cassette 19b is removed from cassette feeder 17a, the left end of lever 205b remains in a downward position; consequently, roller 89b is placed in the second position disengaged from the top sheet. When cassette 19b is fully inserted into cassette feeder 17a and handle 157b is located in a predetermined position (i.e., claw 179b engages clasp 181b), projection 207b forces upwardly the left end of lever 205b. As a result, roller 89b engages the top sheet of the paper. Pick-up roller 89b is then positioned in the first position.

The mechanism for operating paper lifting member 85, which urges paper receiving plate 87 upwardly, will be explained with reference to FIGS. 4, 5 and 6. As described above, cassette 19b includes paper receiving plate 87b that is urged upwardly by paper lifting member 85b located in cassette feeder 17a. Member 85b comprises a plate that is movably attached to an axle 211b for movement therewith. Also attached to the axle 211b is a drive gear disengaging member 213b and a sector gear 215b. Upon rotation of paper lifting member 85 by the axle 211b, gear disengaging member 213b and sector gear 215b are simultaneously moved.

Drive gear disengaging member 213b comprises a cutout portion 217b and an arm portion 219b. Arm portion 219b has a cross-sectional U-shape(see FIG. 4) wherein the upper surface of the U has a flat plane portion 221b. A spring 227b urges cutout portion 217b downwardly so that it is rotated clockwise if no additional force is applied, such as for example the projection 225b being pushed down as described below. A spring 222b urges sector gear 215b upwardly so that it is normally rotated counterclockwise. Springs 222b and 227b cause axle 211b to rotate, thereby rotating member 213b and sector gear 215b. The force of spring 222b is greater than spring 227b; consequently, axle 211b is normally rotated counterclockwise so that paper lift member 85b is positioned below cassette 19b (i.e., member 85b fails to lift paper receiving plate 87b).

An angled plate 223b is provided between handle projection portion 163b and plane portion 221b of drive gear disengaging member 213b. Plate 223b is coupled to clasp 181a of lower cassette 19a. A projection 225b is coupled to the lower surface of angled plate 223b. Upon fully inserting cassette 19b into cassette feeder 17a, handle projection portion 163b contacts angled plate 223b which, in turn, contacts portion 221b of arm portion 219b.

Assume that paper lifting member 85b is urging paper receiving plate 87b upwardly in order to feed paper into image forming section 13. When handle grip portion 161b is moved clockwise in the direction of arrow B (see FIG. 4) to release the claw 179b for removing the cassette 196, handle projection portion 163b moves toward arm portion 219b via angled plate 223b. As shown in FIG. 5, projection 225b applies pressure to the end of arm portion 219b so that drive gear disengaging member 213b is rotated counterclockwise around on axle 211b in the direction of the arrow D. As a result and as will be explained below, the paper lifting drive gears will be disengaged so that paper lifting member will be inoperative until the cassette is returned to the feeder. As axle 211b is rotated counterclockwise, this, in turn, moves paper lifting member 85b downwardly. Accordingly, paper receiving plate 87b (see FIG. 2) is moved downwardly to the lowermost position in cassette 19b. The movement of member 85b below the cassette prevents its interference with removal of the cassette from the feeder.

As previously discussed, paper lifting member 85b urges paper receiving plate 87b upwardly so that the top sheet of papers P is located in the first position (i.e., the downward position of pick-up roller 89b). The position of the top sheet depends on the amount of stored papers and the extent exle 211b has rotated. According to the present embodiment, a paper sensor 301b (See FIG. 6) detects the position of the top sheet. CPU 303 receives a signal indicating that the top sheet has reached the first position and then provides control to a drive mechanism, as described later.

An identical drive mechanism is provided for each of the lower and upper cassette feeders 17a and 17b. The driving mechanism comprises a pulse motor 305a which responds to signals supplied by CPU 303. The drive shaft of pulse motor 305a has a pulley thereon which is coupled to a first pulley gear 307a through a timing belt 308a.

Gear 307a comprises a pulley portion and a gear portion having concentric configuration. The diameter of the pulley portion is larger than the drive shaft pulley of pulse motor 305a. Thus, the rotational speed of first pulley gear 307a is slower than that of the pulse motor 305a. First pulley gear 307a rotates a second pulley gear 309a, while second pulley gear 309a rotates a pulley 311a provided for upper cassette 19b via a timing belt 313a. The rotational axis of second pulley gear 309a extends through a first spring clutch 315a, a first gear 317a and a second spring clutch 319a. First gear 317a is located between first and second spring clutches 315a and 319a.

First gear 317a rotates a second gear 321a through a third gear 323a and a fourth gear 325a. The rotational axes of first, third and fourth gears 317a, 323a, and 325a are coupled to the body of cassette feeder 17a. Rather than being connected to the cassette feeder body, the axis 327a of second gear 321a is connected to an axis 331a of gear 325a by a pivotably mounted connecting plate 329a; consequently, gear 321a acts as a floating gear. This is achieved because plate 329a is rotatable around on axis 331a, axis 331a being fixed to the body of cassette feeder 17a. A spring 333a (See FIG. 5) normally pulls plate 329a toward the cogs of sector gear 215a so that gear 321a engages sector gear 215a. The axes of first, second, third, and fourth gears 317a, 321a, 323a, and 325a are parallel. As will be discussed below, sector gear 215a is removably coupled to second gear 321a.

Figure 6:
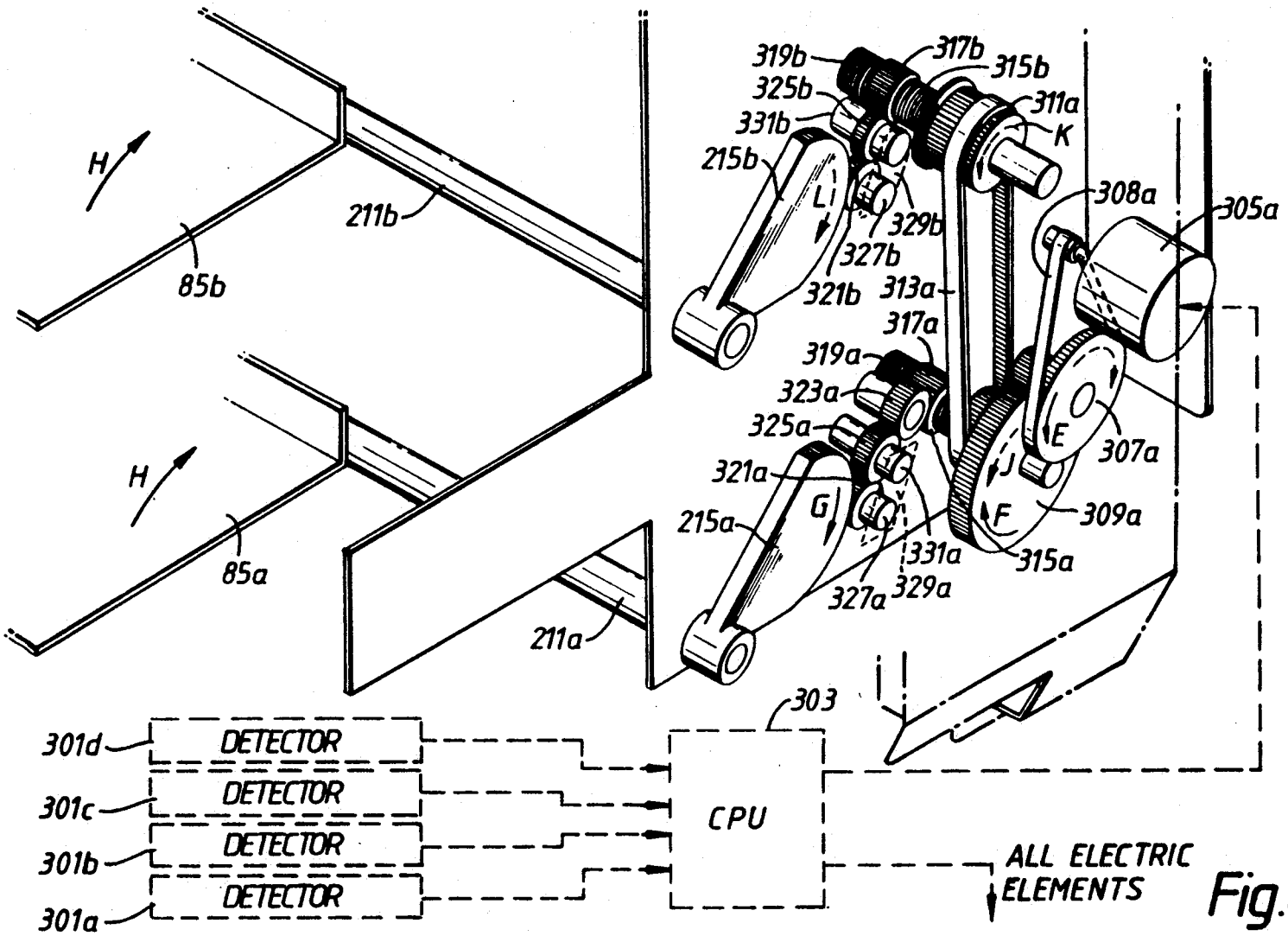
FIG. 6 is a perspective view of the drive mechanism used in the copying machine shown in FIG. 1.

As shown in FIG. 6, the rotational axis of pulley 311a extends through a third spring clutch 315b, a fifth gear 317b, and a fourth spring clutch 319b. Fifth gear 317b rotates a sixth gear 321b through a seventh gear 325b. The relationship among fifth, sixth, and seventh gears 317b, 321b, and 325b is the same as the relationship, discussed above, among for corresponding first, third and fourth gears 317a, 323a and 325a. Rather than being connected to the cassette feeder body, the axis 327b of sixth gear 321b is connected to the axis 331b of gear 325b by connecting plate 329b. The axis 331b of seventh gear 325b is coupled to the cassette feeder's body.

Figure 7:
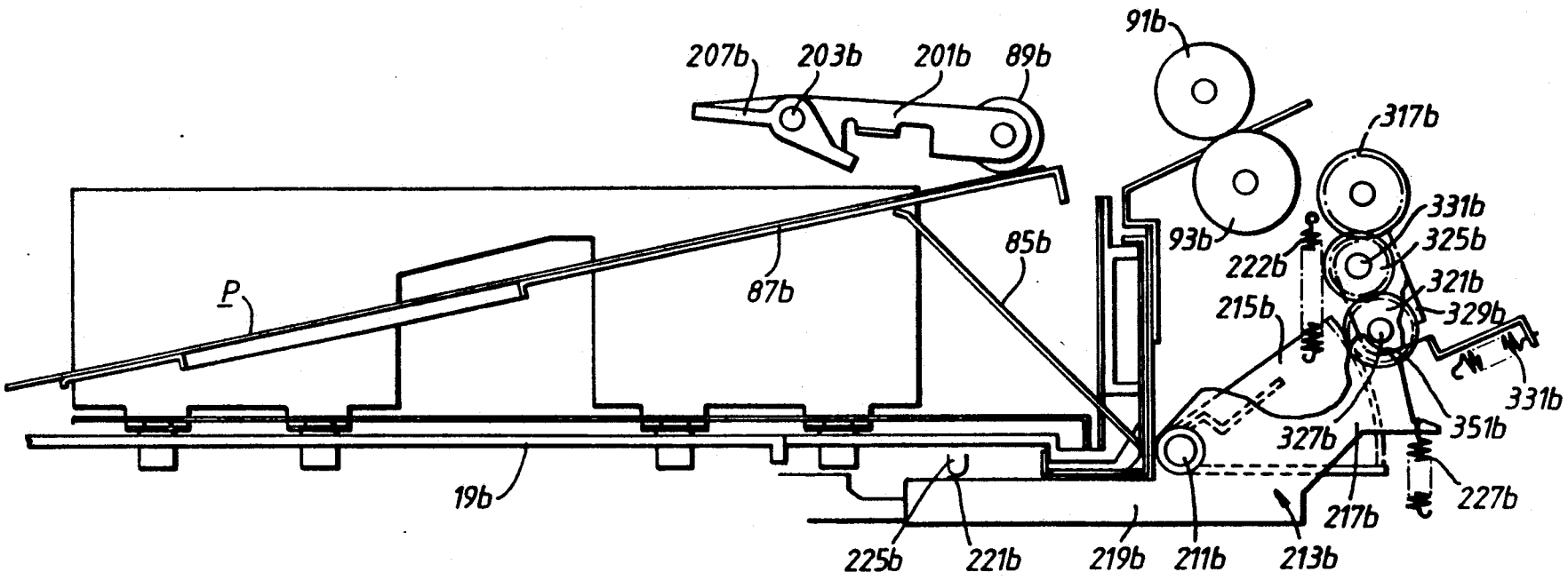
FIG. 7 illustrates the movement of the sheet lifting member driven by the drive mechanism shown in FIG. 6.

Referring now to FIGS. 6, 7 and 8, the movement of the spring clutches and the driving mechanism will be explained. The movement of a spring clutch depends on the winding direction of a spring around an axis. The direction of winding of the spring of first spring clutch 315a is opposite to that of second spring clutch 319a but is the same as that of the fourth spring clutch 319b. The direction of winding of the spring of second spring clutch 319a is the same as that of the third spring clutch 315b. Thus, the movement of first and fourth spring clutches 315a and 319b are the same, while the movement of second and third spring clutches 319a and 315b are the same.

Assuming the operator selects cassette 19a, CPU 303 causes pulse motor 305a to rotate counterclockwise, thereby causing pulley gear 307a to be rotated counterclockwise (i.e., in direction E, as shown in FIG. 6). In response to the rotation of gear 307a, second pulley gear 309a is rotated clockwise (i.e., in the direction of arrow F). In response to the rotation of the axis of pulley gear 309a, the spring of first spring clutch 315a winds in the tightening direction while the spring of second spring clutch 319a will unwind. Therefore, the rotational force of second pulley gear 309a, through first spring clutch 315a, causes first gear 317a to be rotated in a clockwise direction. Simultaneously, second spring clutch 319a runs idle. The rotation of first gear 317a, through third and fourth gears 323a and 325a causes second gear 321a to be rotated counterclockwise. The counterclockwise rotation of second gear 321a, causes sector gear 215a to rotate in the direction of arrow G. In response to the rotation of sector gear 215a, paper lifting member 85a is rotated upwardly about axis 211a in the direction shown. The movement of paper lifting member 85a and its subsequent contact with paper receiving plate 87a caused plate 87a to be rotated upwardly as shown in FIG. 7.

As described above, second pulley gear 309a rotates pulley 311a. As described below, the rotational direction of gear 307a determines whether paper lifting member 85a or 85b will be moved upwardly. At first, it is assumed that gear 307a rotates in a counterclockwise direction, forcing second pulley gear 309a and pulley 311a to be rotated in a clockwise direction. In response to the clockwise rotation of pulley 311*a* and therefore its axis, second and third spring clutches 315*b* and 319*b* are rotated clockwise. As a result, the spring of third spring clutch 315*b* unwinds, while the spring of fourth spring clutch 319*b* winds around the axis of pulley 311*a*. Therefore, pulley 311*a* causes third spring clutch 315*b* to run idle while the fourth spring clutch 319*b* prevents fifth gear 317*b* from rotating. Consequently, no drive power will be provided to sector gear 215*b*, provided for the upper cassette in cassette feeder 17*a*, to move paper lifting member 85*b*. Only papers stored in lower cassette 19*a* will move toward their pick-up roller. As described above, detector 301*a* detects when the top sheet of paper stored in cassette 19*a* is located in the first position. In response to a detection signal from detector 301*a*, CPU 303 stops further rotation of motor 305*a* as the top sheet is brought into contact with pick-up roller 89*a*.

In the event the operator selects cassette 19*b*, CPU 303 causes pulse motor 305*a* and therefore gear 307*a* to rotate clockwise. Second pulley gear 309*a* rotates counterclockwise in the direction of arrow J (FIG. 6). As a result, first gear 317*a* fails to rotate while fifth gear 317*b* rotates in a counterclockwise direction, as shown by arrow K. Sixth gear 321*b* rotates counterclockwise so that sector gear 215*b* rotates downwardly as shown by arrow L. In this case, however, the rotation of gear 309*a* in a counterclockwise direction, disengages spring clutch 315*a* so that drive power is not transferred to sector gear 215*a*.

Figure 8A:
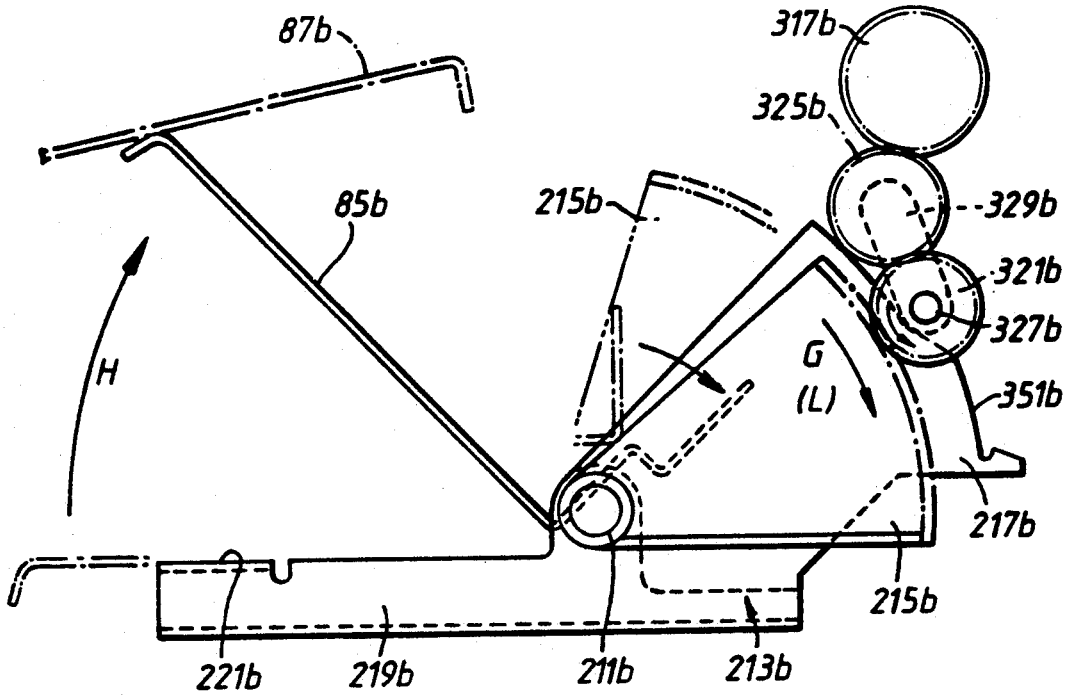
FIGS. 8A and 8B illustrate in detail the movement of the sheet lifting member and the drive gear disengaging member shown in FIG. 7.
Figure 8B:
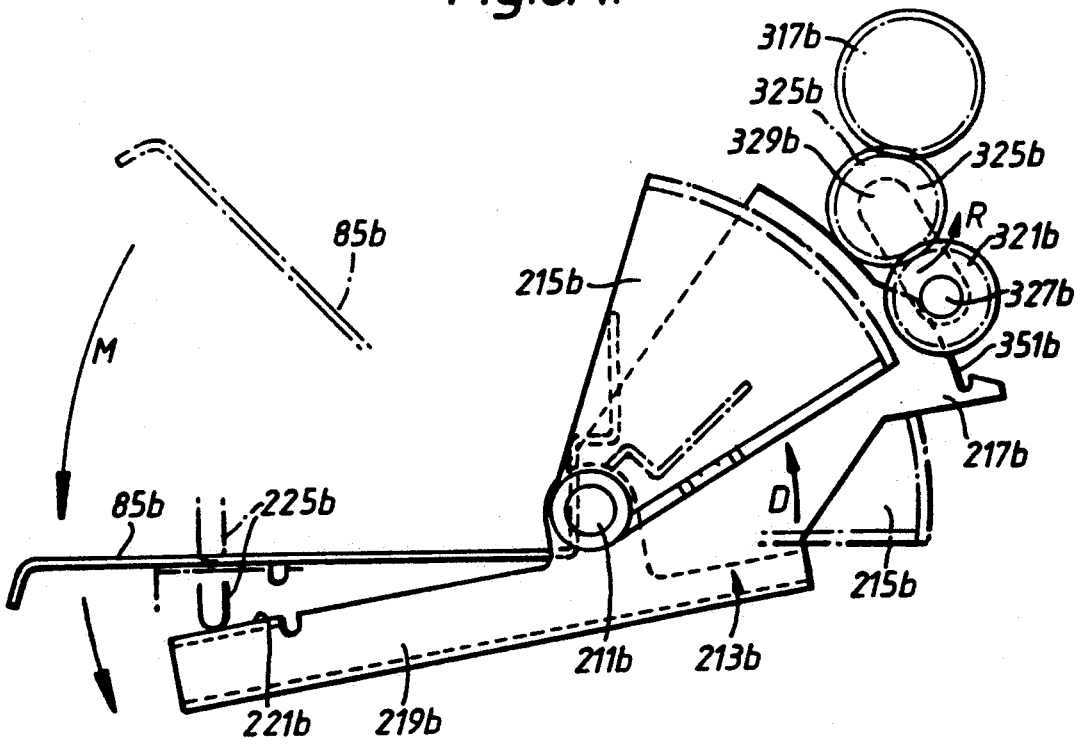

The movement of paper lifting member 85 and drive gear disengaging member will be further explained. In response to the movement of handle 157*b*, projection 225*b* rotates drive gear disengaging member 213*b* counterclockwise in the direction of arrow D (FIG. 8B). However, axis 211*b*, the rotational axis of drive gear disengaging member 213*b*, is coupled to sector gear 215*b* which engages second gear 321*b*. Furthermore, spring 333*b* (see FIG. 5) forces second gear 321*b* toward sector gear 215*b* so that it will rotate gear 215*b* as shown in FIG. 8A. Due to this structure, pulse motor 305*a* (see FIG. 6) is able to correctly rotate paper lifting member 85*b*.

As drive gear disengaging plate 213*b* is rotated in response to the movement of projection 225*b*, removal portion 217*b* is brought into contact with second gear 321*b* through curved periphery 351*b*. The lower portion of curved periphery 351*b* is expanded. Therefore, as disengaging member 213*b* is rotated counterclockwise, curved periphery 351*b* of disengaging member 213*b* forces axis 327*b* upwardly as shown in FIG. 8B. As described above, axis 327*b* is not connected to the body of cassette feeder 19*a* but is coupled to connecting plate 329*b*. Connecting plate 329*b* is coupled to the axis of fourth gear 325*b* which is coupled to the body of cassette feeder 19*a*. Therefore, connecting plate 329*b* and second gear 321*b* are moved counterclockwise about the axis of fourth gear 325*b* in direction R. As a result, second gear 321*b* is separated from sector gear 215*b* so that any predetermined movement of gear 321*b* will not be transferred to gear 215*b*. Under this condition, spring 222*b* (See FIG. 5) forces gear 215*b* upwardly. The pulley strength of spring 222*b* of gear 215*b* is stronger than the strength of spring 227*b*; therefore, axis 211*b* is rotated counterclockwise.

According to the present embodiment, paper lifting members 85*a*, 85*b*, 85*c*, and 85*d* are positioned below the cassettes when cassettes 19*a*, 19*b* and 19*d* are inserted into or pulled from cassette feeders 17*a* and 17*b*. This structure provides a plurality of advantages. For example, there is no need to include a spring within each cassette; therefore the structure of each cassette is extremely simple. Furthermore, each cassette is able to store more paper than will spring-designed cassettes.

It is apparent to apply the present invention to a laser printer or a facsimile machine. Especially, the present invention does not depend on an image-forming method or a recording method. Cassette feeder 17 may accommodate one or more than two cassettes. Handle 157*b* may directly operate cam removal plate 213*b* without the need for plate 223*b*.

Other objects, features and advantages of the present invention will become apparent from the above detailed description. It should be understood, however, that the detailed description and specific examples, while indicating preferred embodiments of the invention, and given by way of illustration only, since various changes and modifications within the spirit and scope of the invention will become apparent to those skilled in the art.

What is claimed is:

1. An apparatus for forming an image on sheet material, comprising:

means for forming an image on an image-bearing member;

housing means for accommodating said image-forming means;

means in said housing for inserting and withdrawing cassette means with respect to said image forming-means;

said inserting and withdrawing means receiving cassette means detachably mounted in said housing including a base area for storing a plurality of material sheets, and a grip portion operable for releasing said cassette means from said housing means;

sheet material urging means including a plate rotatable with an urging axle and motor means for rotating the urging axle positioned adjacent said cassette means operable through the base area thereof for urging said sheet material upwardly;

feeding means operative to feed the upwardly urged sheet material in a first direction for bringing it in contact with said image-bearing member; and means operated in response to said grip portion for disengaging said urging means from said cassette means whereby the cassette means is movable with respect to said inserting and withdrawing means in a second direction perpendicular to the first direction.

2. The apparatus of claim 1, wherein said grip portion comprises:

a body mounted for pivotal movement having a handle portion that is gripped to release said cassette means from said housing means; and means for transmitting the motion of said handle portion to said disengaging means for disengaging said urging means from said cassette means in response to the movement of said handle portion

3. The apparatus of claim 2, wherein the transmitting means comprises a cam lobe portion coupled to the handle portion.

4. The apparatus of claim 1, wherein the disengaging means comprises separating means for separating the motor means from the plate.

5. The apparatus of claim 1 wherein the motor means comprises a motor gear operably connected to a gear portion formed on the plate, and the disengaging means comprises a disengaging plate rotatably mounted to the urging axle for rotation in response to movement of the grip portion to separate said gear portion from said motor gear.

6. The apparatus of claim 1, wherein the cassette means further comprises:

a cassette body having four walls and an open base area;

sheet receiving means positioned at the base of the cassette body for receiving a plurality of the material sheets; and shoulder means, positioned at the perimeter of the open base area of the cassette body for supporting the sheet receiving means.

7. The apparatus of claim 1, wherein the feeding means comprises:

pick-up means for picking up the material sheets urged by the urging means; and roller means for transporting the material sheets to the image bearing member.

8. The apparatus of claim 1 wherein the urging means comprises:

first gear means, coupled to the housing means, which engages the axle;

a second gear device, engaged by the first gear means, which is movably mounted on the housing means;

a sector gear device, movable about a sector axis coupled to the housing and engaging the second device;

lifting means disposed concentrically with the sector axis for lifting the sheet material in response to the rotation for the sector axis; and disengaging means for disengaging the second gear device from the sector gear device in response to the action of the grip portion.

9. An apparatus for forming an image on sheet material, comprising:

means for inserting and withdrawing cassette means with respect to their operative position in relation to said image bearing member;

means for forming an image on an image bearing member;

first cassette means for storing sheet material on a base area of the cassette means, the first cassette means including a grip portion;

second cassette means for storing a plurality of material sheets on a base area of the cassette means, the second cassette means including a grip portion;

first urging means, positioned adjacent the first cassette means, for urging the material sheets upwardly through the base area of the first cassette means;

second urging means, positioned adjacent the second cassette means, for urging the material sheets upwardly through the base area of the second cassette means;

driving means for selectively driving one of the first or the second urging means;

feeding means for feeding the sheet material urged by one of the first and the second urging means in a first direction so that the sheet material fed by the feeding means is brought in contact with the image bearing member;

means for transferring the image onto the sheet material fed by the feeding means; and means for selectively disengaging the respective urging means from the associated cassette means in response to the action of the grip portion thereof so that the cassette means is movable with respect to said inserting and withdrawing means in a second direction perpendicular to the first direction.

10. The apparatus of claim 9, including housing means wherein the driving means comprises:

motor means for rotating a first axle;

first pulley means coupled to said housing means for rotating a second axle in response to the rotation of the first axle;

a first gear device movably mounted on the housing means for engaging the first axle;

a first sector gear device movably centering around a first sector axle coupled to the housing means for engaging the gear sector axle whereby the urging means urges the sheet material in response to the rotation of the first sector axle; and first disengaging means for disengaging the first gear device from the sector gear device in response to the action of the grip portion;

second pulley means for rotating a third axle in response to the rotation of the first axle;

a second gear device axle movably mounted on the housing means for engaging a second axle;

a second sector gear movably centering around a second sector axle coupled to the housing means and engaging the second gear device, said second urging means being disposed concentrically with the second sector axle whereby the second urging means urges the sheet material in response to the rotation of the second sector axle;

second disengaging means for disengaging the second gear device from the sector gear device in response to the action of the grip portion; and selecting means for selecting one of the first and the second pulley means for activation in response to the rotation of the first axis.

11. The apparatus of claim 9 wherein the selecting means comprises:

a motor means for rotating the third axle in response to rotation of said first axle by said motor and for preventing the rotation of the third axle when the first axle is driven in the opposite direction by the motor; and a belt operable between the second axle and the third axle for selectively rotating one of the first and the second axle depending on the direction of rotation of the motor.

* * * * *